US008469771B2

(12) United States Patent
Francis

(10) Patent No.: US 8,469,771 B2
(45) Date of Patent: Jun. 25, 2013

(54) NIPPLE SHIELD

(75) Inventor: Jimi Francis, Sparks, NV (US)

(73) Assignee: Handi-Craft Company, St. Louis, MO (US)

( * ) Notice: Subject to any disclaimer, the term of this patent is extended or adjusted under 35 U.S.C. 154(b) by 289 days.

(21) Appl. No.: 12/879,476

(22) Filed: Sep. 10, 2010

(65) Prior Publication Data

US 2011/0065360 A1 Mar. 17, 2011

Related U.S. Application Data

(60) Provisional application No. 61/241,685, filed on Sep. 11, 2009, provisional application No. 61/245,542, filed on Sep. 24, 2009.

(51) Int. Cl.
*A41C 3/00* (2006.01)

(52) U.S. Cl.
USPC ..... 450/37; 604/74

(58) Field of Classification Search
USPC ..... 450/37, 36, 54–58; 604/74–76, 119–121, 604/151–152, 154, 346; 607/108, 106, 110
See application file for complete search history.

(56) References Cited

U.S. PATENT DOCUMENTS

| | | | |
|---|---|---|---|
| 16,396 | A | 1/1857 | Parker |
| 77,393 | A | 4/1868 | McLaughlin |
| 78,881 | A | 6/1868 | Libbey |
| 114,281 | A | 5/1871 | Foster |
| 751,415 | A | 2/1904 | Prindle |
| 1,032,518 | A | 7/1912 | Thieringer |
| 1,082,198 | A | 12/1913 | Jencsa |
| 1,165,275 | A | 12/1915 | Montgomery |
| 2,108,205 | A | 2/1938 | Martin |
| 2,364,866 | A | 12/1944 | Meynier, Jr. |
| 2,495,307 | A | 1/1950 | Abramson |
| 2,543,499 | A | 2/1951 | Kausch |
| 4,195,639 | A | 4/1980 | Lee |
| D306,346 | S | 2/1990 | Saras |
| D321,058 | S | 10/1991 | Dickinson |
| 5,281,186 | A | 1/1994 | Buckley et al. |
| D365,399 | S | 12/1995 | Silver |
| 5,476,490 | A | 12/1995 | Silver |
| D381,752 | S | 7/1997 | McCoy |
| D383,541 | S | 9/1997 | Strain |
| D384,414 | S | 9/1997 | Pernarella |

(Continued)

FOREIGN PATENT DOCUMENTS

| | | | |
|---|---|---|---|
| DE | 4415939 | C1 | 1/1996 |
| DE | 20219950 | U1 | 3/2003 |
| JP | 2000325433 | A | 11/2000 |
| SE | 528831 | C2 | 2/2007 |

OTHER PUBLICATIONS

International Search Report & Written Opinion for PCT/US2010/048448, dated Nov. 4, 2010.

*Primary Examiner* — Gloria Hale
(74) *Attorney, Agent, or Firm* — Armstrong Teasdale LLP

(57) ABSTRACT

A nipple shield includes a base portion having a cutout for allowing a nose of the baby to contact the mother's breast during breastfeeding and a nipple portion that extends outward from the base portion. The nipple portion includes a sidewall and a generally flat end wall that has a plurality of openings therein. The nipple portion is configured for receiving the nipple therein and to be placed in the baby's mouth during breastfeeding.

21 Claims, 11 Drawing Sheets

U.S. PATENT DOCUMENTS

| | | | | |
|---|---|---|---|---|
| 5,776,177 | A | 7/1998 | MacWhinnie et al. | |
| D398,398 | S | 9/1998 | Taggerty | |
| 5,897,580 | A | 4/1999 | Silver | |
| D417,735 | S | 12/1999 | Ford | |
| 6,039,629 | A | 3/2000 | Mitchell | |
| 6,261,313 | B1 | 7/2001 | MacWhinnie et al. | |
| 6,338,665 | B1 | 1/2002 | Dawson et al. | |
| 6,387,072 | B1 | 5/2002 | Larsson et al. | |
| 6,540,585 | B1 | 4/2003 | Lee | |
| 6,669,064 | B2 | 12/2003 | Perricone | |
| 6,673,036 | B1 * | 1/2004 | Britto | 604/74 |
| 6,673,037 | B1 * | 1/2004 | Silver | 604/74 |
| 6,723,066 | B2 | 4/2004 | Larsson et al. | |
| 6,887,218 | B2 * | 5/2005 | Warburton | 604/74 |
| 6,962,519 | B1 | 11/2005 | Clark | |
| 7,152,606 | B1 * | 12/2006 | Schindler | 128/889 |
| 7,175,502 | B2 | 2/2007 | Clark | |
| D550,851 | S | 9/2007 | Roehrig | |
| D584,399 | S | 1/2009 | Pacini | |
| D598,117 | S | 8/2009 | Yamashita et al. | |
| 8,052,634 | B2 * | 11/2011 | Thommen et al. | 604/74 |
| 2004/0178162 | A1 | 9/2004 | Zucker-Franklin | |
| 2005/0239369 | A1 | 10/2005 | Clark | |
| 2005/0261738 | A1 | 11/2005 | Garrett | |
| 2006/0030239 | A1 | 2/2006 | Clark | |
| 2006/0111665 | A1 | 5/2006 | Gillan | |
| 2006/0116632 | A1 | 6/2006 | Gillan | |
| 2006/0157065 | A1 | 7/2006 | Rohrig | |
| 2009/0124967 | A1 | 5/2009 | Zucker-Franklin | |
| 2009/0194116 | A1 | 8/2009 | Pacini | |
| 2009/0283101 | A1 | 11/2009 | Mans | |

* cited by examiner

NIPPLE SHIELD

CROSS REFERENCE TO RELATED APPLICATIONS

This application claims the benefit of U.S. Provisional Application No. 61/241,685 filed Sep. 11, 2009 and U.S. Provisional Application No. 61/245,542 filed Sep. 24, 2009, which are both incorporated herein in their entireties.

FIELD

The present invention relates generally to a nipple protection device for breastfeeding mothers and, more particularly, to a nipple shield for covering a nipple and at least a portion of the breast surrounding the nipple during breastfeeding.

BACKGROUND

Nursing mothers are known to experience some discomfort during breastfeeding, particularly due to sensitive, sore and/or irritated nipples. Such discomfort can effect and sometimes hinder suitable nursing of a baby, as well as detract from the maternal experience in providing care to her baby. To alleviate at least some of the discomfort, some nursing mothers will wear a nipple shield during breastfeeding. Conventional nipple shields are typically smaller than a breast and fit over the nipple and surrounding area. A nipple portion of the shield may partially or fully enclose the mother's nipple. The baby then latches onto the nipple shield and feeds as normal, with the nipple shield at least inhibiting some of the discomfort that may otherwise be experienced upon direct contact of the baby with the mother's nipple.

However, conventional nipples shields have some disadvantages due to inadequate configuration. For example, currently available nipple shields have generally rounded ends so that they do not fit tight against the end of the mother's nipple. This can lead to pooling of breast milk within the nipple shield and can also result in additional discomfort for the breastfeeding mother due to pinching or rubbing of the nipple shield against the nipple. The cylindrical shape of the nipple portion of conventional nipple shield can also result in pooling and additional discomfort.

Additionally, the base portion of current nipple shields (i.e., the part that seats against the mother's breast) covers too much of the breast, resulting in the baby's face and in particular the baby's nose to press against the base portion of the nipple shield during feeding. This is a less natural feeling for the baby and may inhibit proper latching, or cause the baby to not want to feed while the mother is wearing the nipple shield.

SUMMARY

In one aspect, a nipple shield for shielding a nipple and a portion of a breast that surrounds the nipple of a nursing mother while breastfeeding a baby generally comprises a base portion having a cutout for allowing a nose of the baby to contact the mother's breast during breastfeeding and a nipple portion that extends outward from the base portion. The nipple portion comprises a sidewall and a generally flat end wall that has a plurality of openings therein. The nipple portion is configured for receiving the nipple therein and to be placed in the baby's mouth during breastfeeding.

In another aspect, a nipple shield for shielding a nipple and a portion of a breast that surrounds the nipple of a nursing mother while breastfeeding a baby generally comprises a base portion having a generally dome shape for cupping the portion of the breast that surrounds the nipple and a nipple portion extending outward from the base portion and defining a chamber configured to receive the nipple. The nipple portion includes a sidewall and a generally flat end wall having a plurality of openings therein. At least some of the openings are arranged in a hexagonal pattern.

In still another aspect, a nipple shield product line generally comprises a small nipple shield that comprises a base portion and a nipple portion extending outward from the base portion, a medium nipple shield that comprises a medium base portion and a medium nipple portion extending outward from the medium base portion, and a large nipple shield that comprises a base portion and a nipple portion extending outward from the base portion. Each of the small, medium, and nipple portions have a diameter, a height, and thereby a diameter-to-height ratio. The diameter-to-height ratios of each of the small, medium, and nipple portions are substantially similar.

Other features of the invention will be in part apparent and in part pointed out hereinafter.

BRIEF DESCRIPTION OF THE DRAWINGS

Corresponding reference characters indicate corresponding parts throughout the drawings.

DETAILED DESCRIPTION OF THE DRAWINGS

Figure 8:
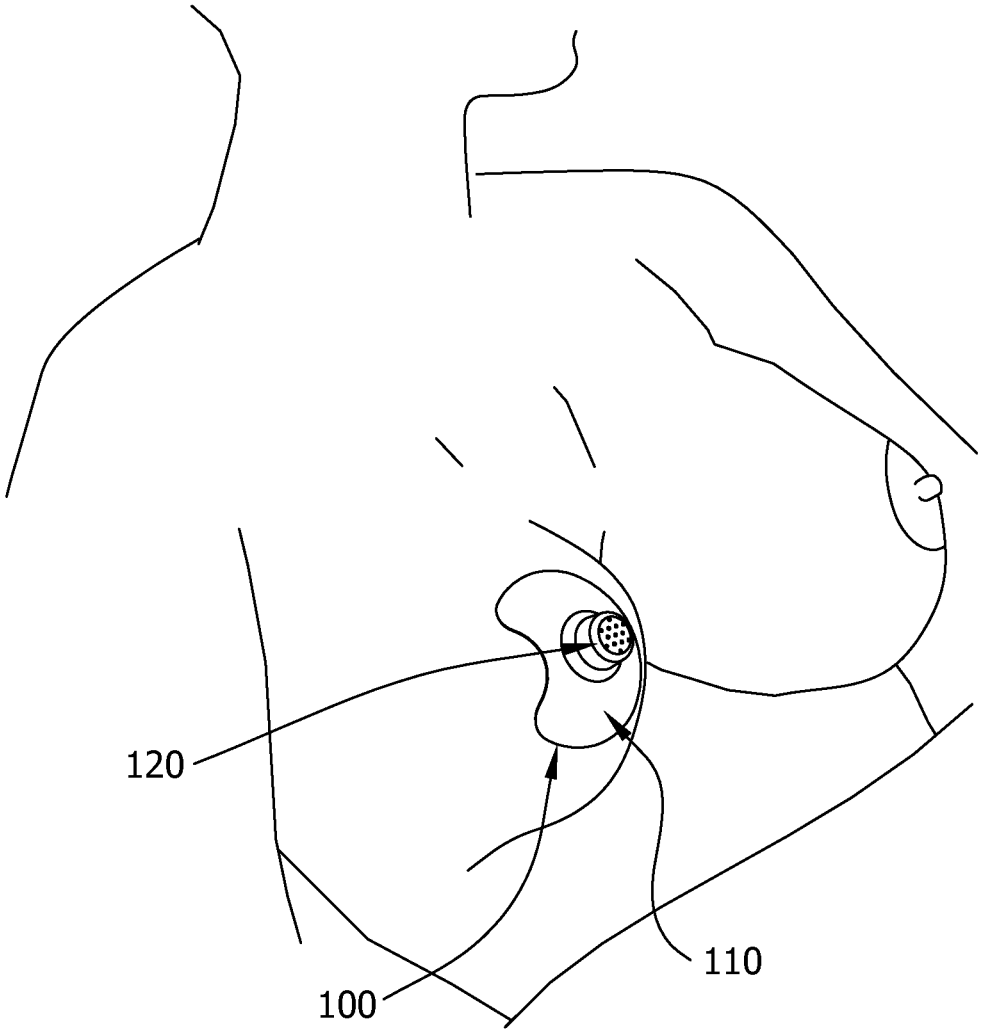
FIG. 8 is a perspective view showing the nipple shield shielding a nipple and a portion of the breast surrounding the nipple of a nursing mother.

FIGS. 1-8 illustrate one suitable embodiment of a nipple shield, which is indicated generally at 100. The nipple shield 100 is configured to shield a nipple and a portion of a breast that surrounds the nipple of a nursing mother during breastfeeding a baby as illustrated in FIG. 8. The nipple shield 100 includes a base portion, indicated generally at 110, and a nipple portion, indicated generally at 120, that extends outward from the base portion.

The illustrated nipple shield 100 is fabricated from a thin, pliant material for enabling the baby to stimulate at least one of the breast and the nipple while the nipple shield 100 is covering the nipple and surrounding portion of the breast during feeding. In one suitable embodiment, the nipple shield 100 is fabricated from a substantially pliable material such as at least one of a rubber material, a silicone material, and a latex material. One exemplary material suitable for fabricating the nipple shield 100 includes LIM 6030 liquid silicone rubber available from Momentive Performance Materials of Albany, N.Y., U.S.A. It is contemplated, however, that the nipple shield 100 may be fabricated from any suitable material without departing from the scope of this invention.

The illustrated nipple shield 100 is suitably transparent or translucent to enable the mother and the baby to see the mother's breast including her nipple through the nipple shield. It is understood, however, that the nipple shield 100 may instead be opaque.

Figure 3:
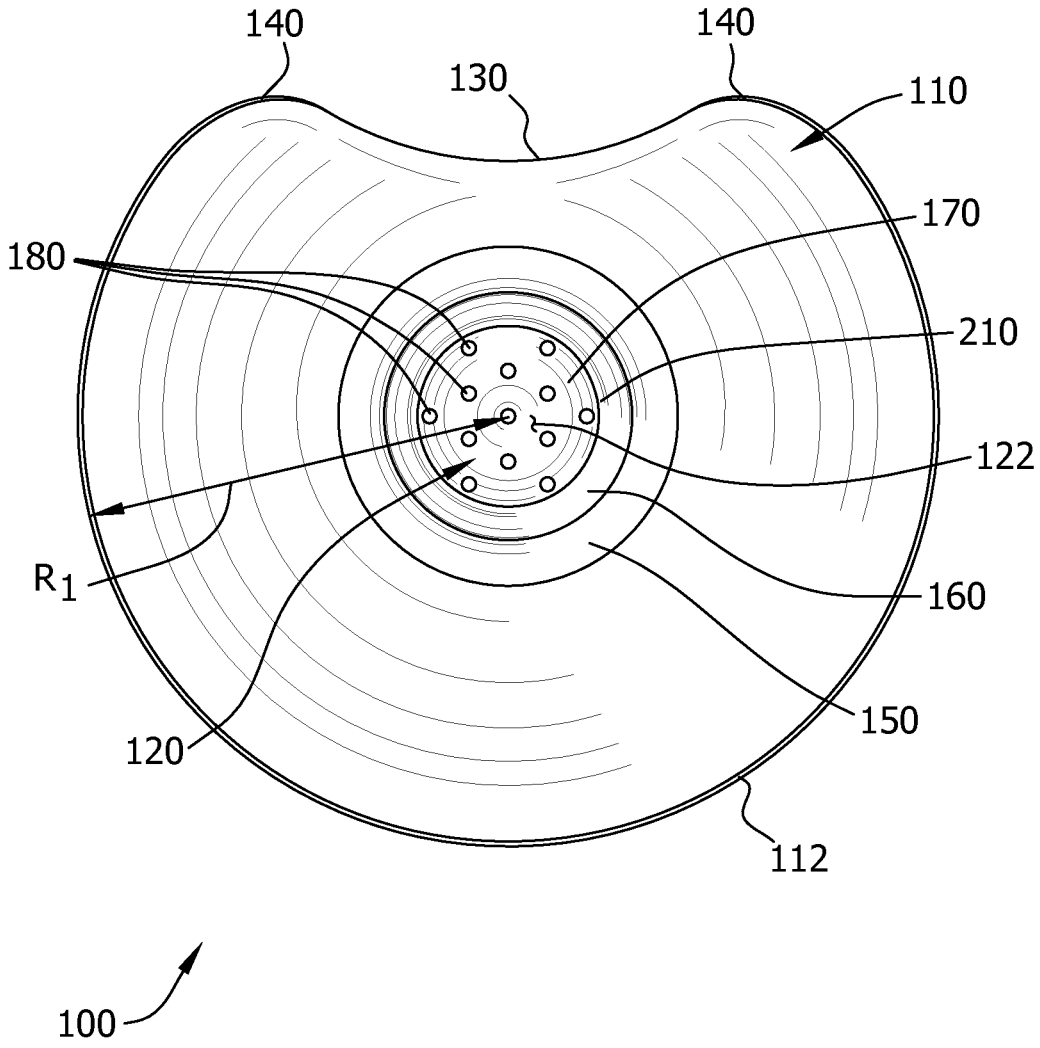
FIG. 3 is a bottom plan view thereof.

As seen in FIGS. 4-8, the base portion 110 of the nipple shield 100 is generally dome-shaped to cup or otherwise receive the portion of the mother's breast that surrounds the nipple. The base portion 100 includes a generally circular outer edge 112. In the illustrated embodiment, the circular outer edge 112 of the base 110 has a radius R1 of about 30 mm (FIG. 3). In other words, the distance between a longitudinal axis LA (FIG. 4) of the nipple shield 100 and the outer edge 122 is about 30 mm. It is contemplated that the circular outer edge 112 of the base 110 may have any suitable radius without departing from the scope of this invention. It is also contemplated that the outer edge 122 can be other than circular (e.g., elliptical, ovate).

Figure 4:
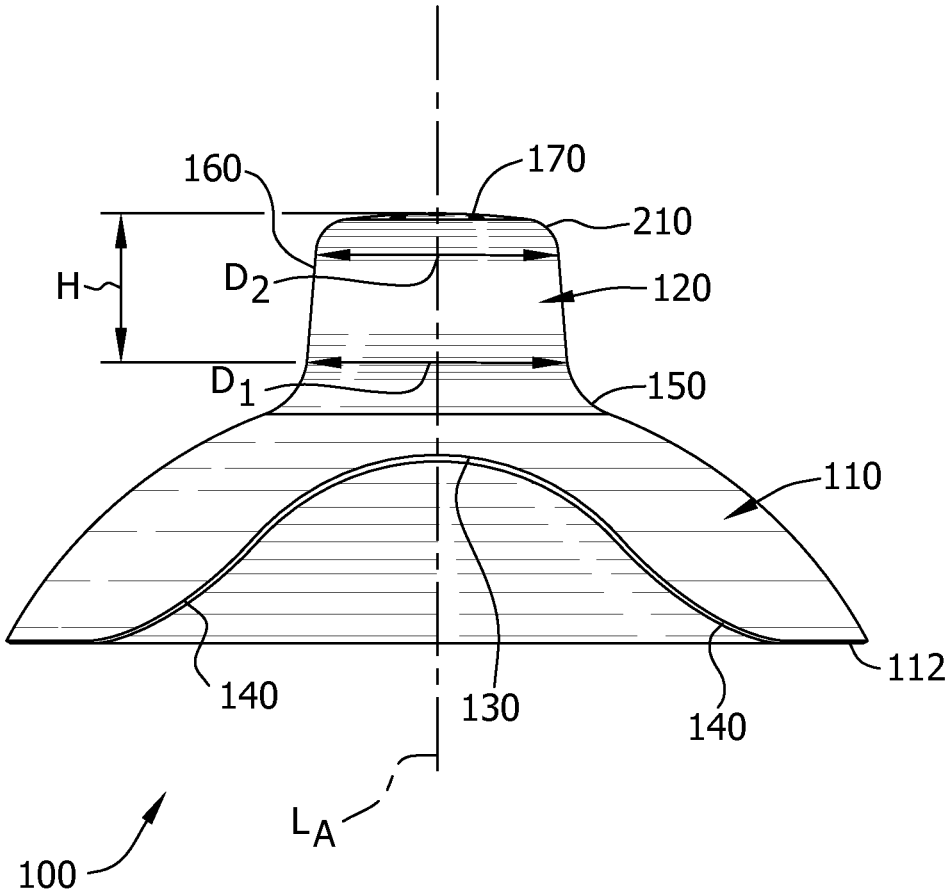
FIG. 4 is a front elevation thereof.
Figure 5:
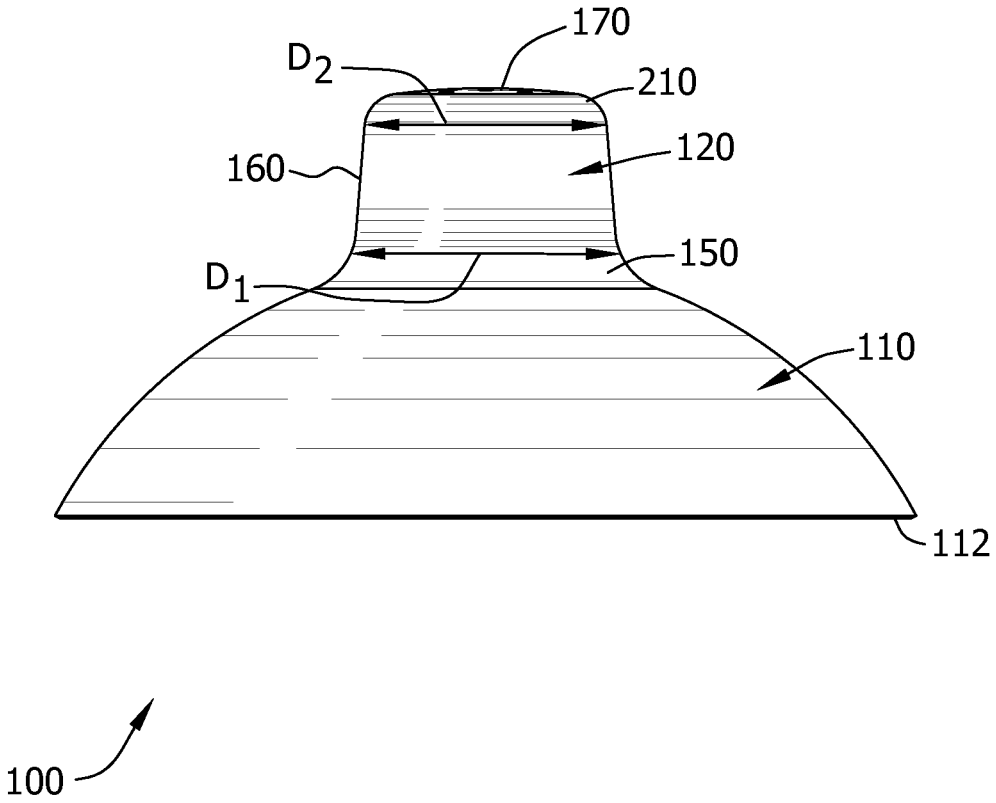
FIG. 5 is a rear elevation thereof.
Figure 6:
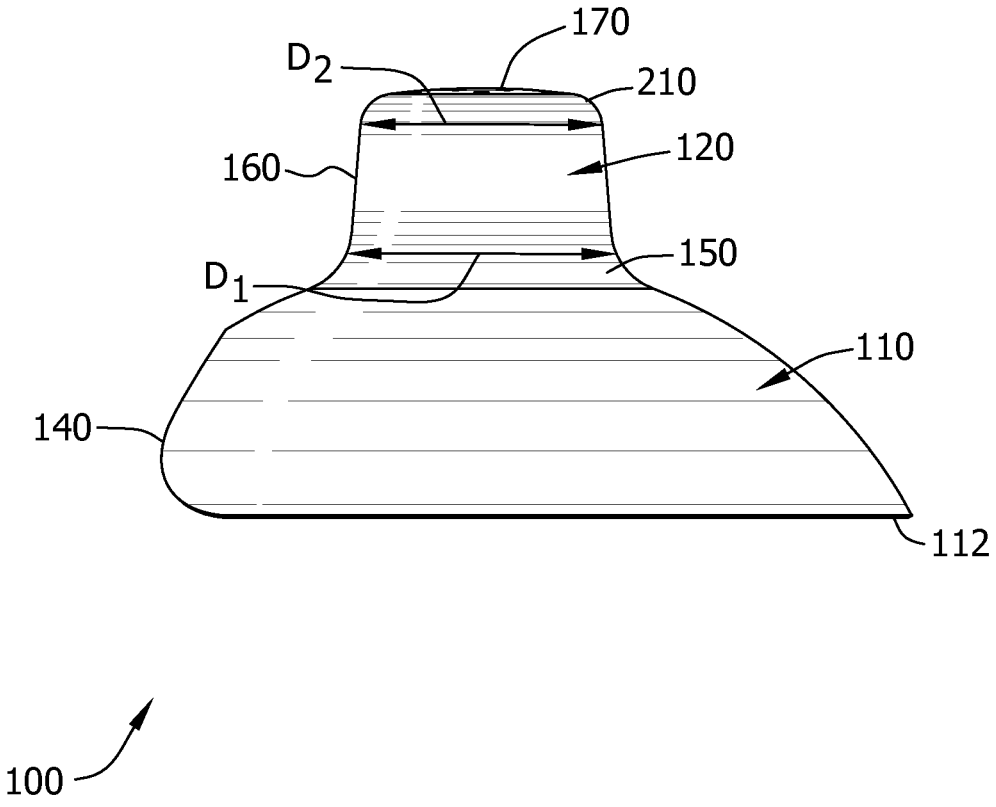
FIG. 6 is a right side elevation thereof.
Figure 7:
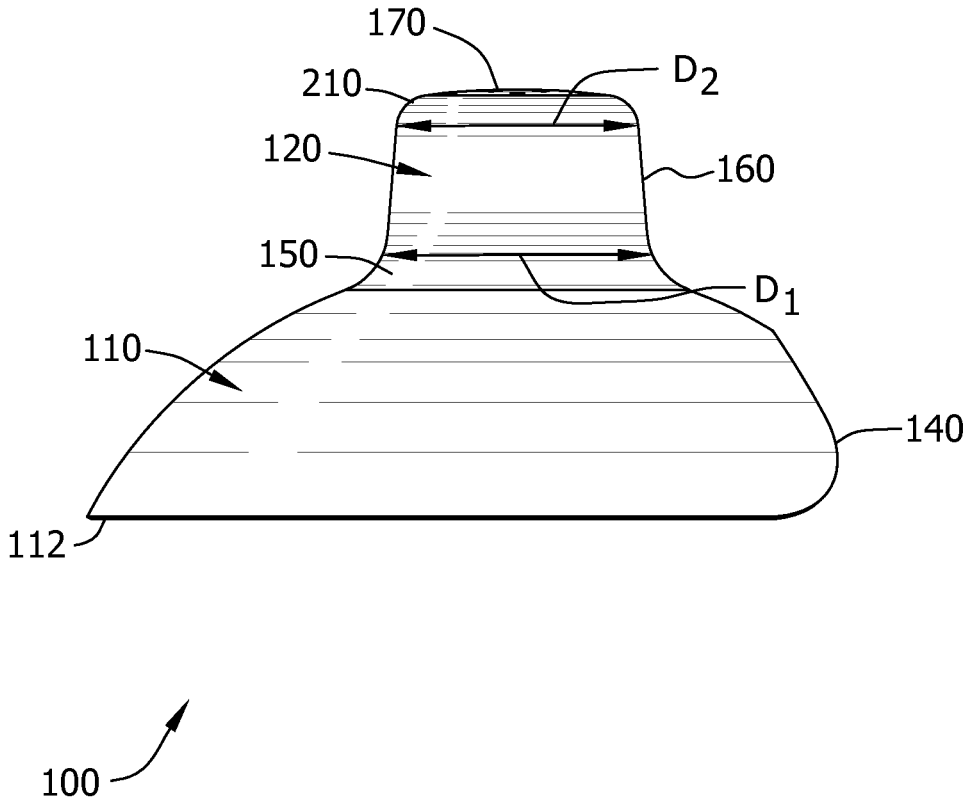
FIG. 7 is a left side elevation thereof.

With reference to FIG. 4, the base portion 110 of the nipple shield 100 includes a generally semicircular cutout 130 that is configured to facilitate direct contact of the baby's nose with the mother's during feeding. In the illustrated embodiment, the cutout 130 has a projected radius R2 (i.e., the radius of the cutout as it is seen in the two dimensional top plan—FIG. 2) of about 25 mm. It is contemplated, however, that the cutout 130 may have any suitable radius without departing from the scope of this invention. It is also contemplated that the cutout 130 may be of another suitable shape besides semicircular.

Figure 2:
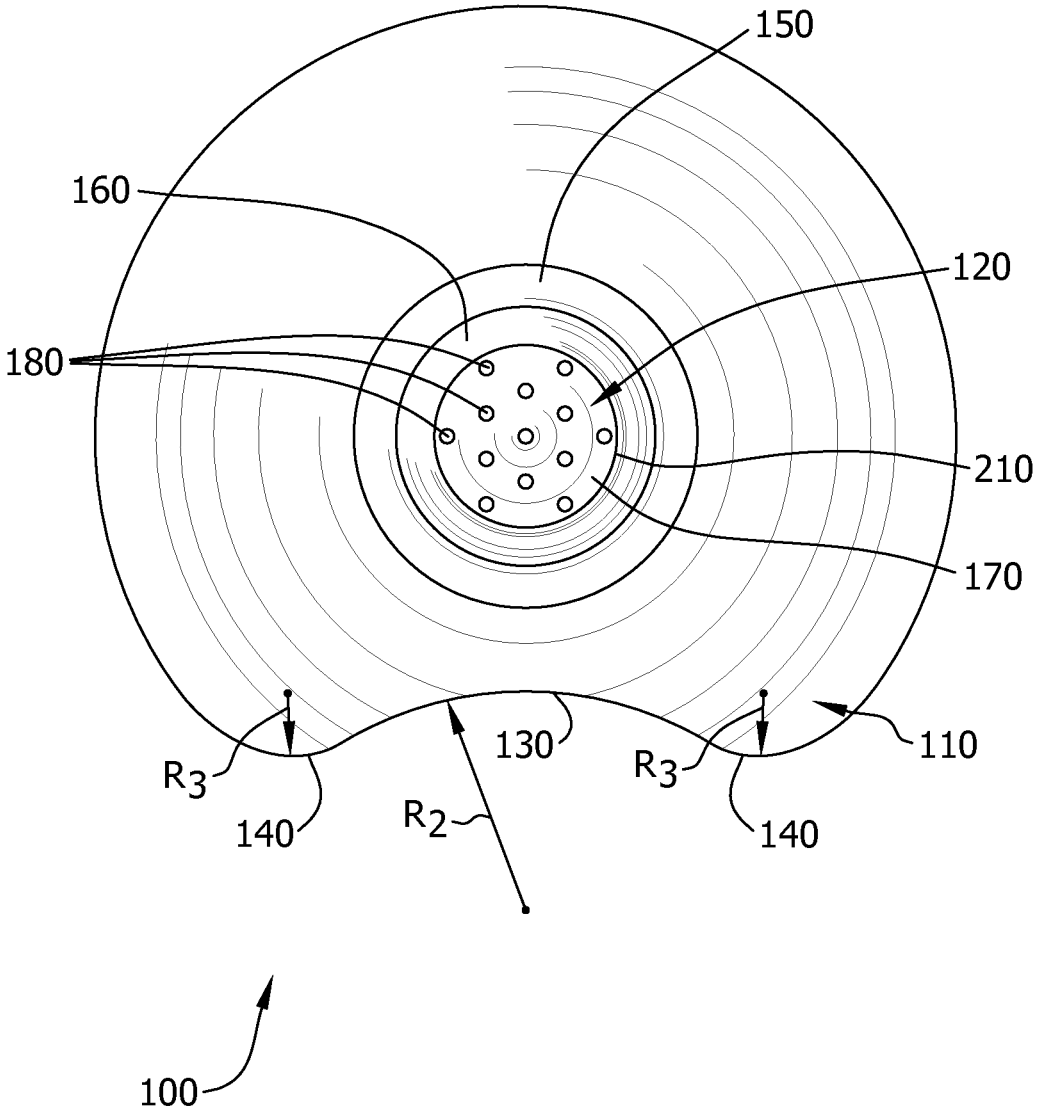
FIG. 2 is a top plan view thereof.

The base portion 110 includes two rounded edge segments 140 that transition from the cutout 130 to remaining circumference of the outer edge 122. One of the edge segments 140 are disposed on one side of the cutout 130 (e.g., the left side as viewed in FIG. 4) and the other edge segment is disposed on the opposite side (e.g., the right side as viewed in FIG. 4). In one suitable embodiment, each of the edge segments 140 has a projected radius R3 of about 10 mm (FIG. 2). Alternatively, the edge segments 140 may have any suitable radius or any suitable shape without departing from the scope of this invention.

Figure 1:
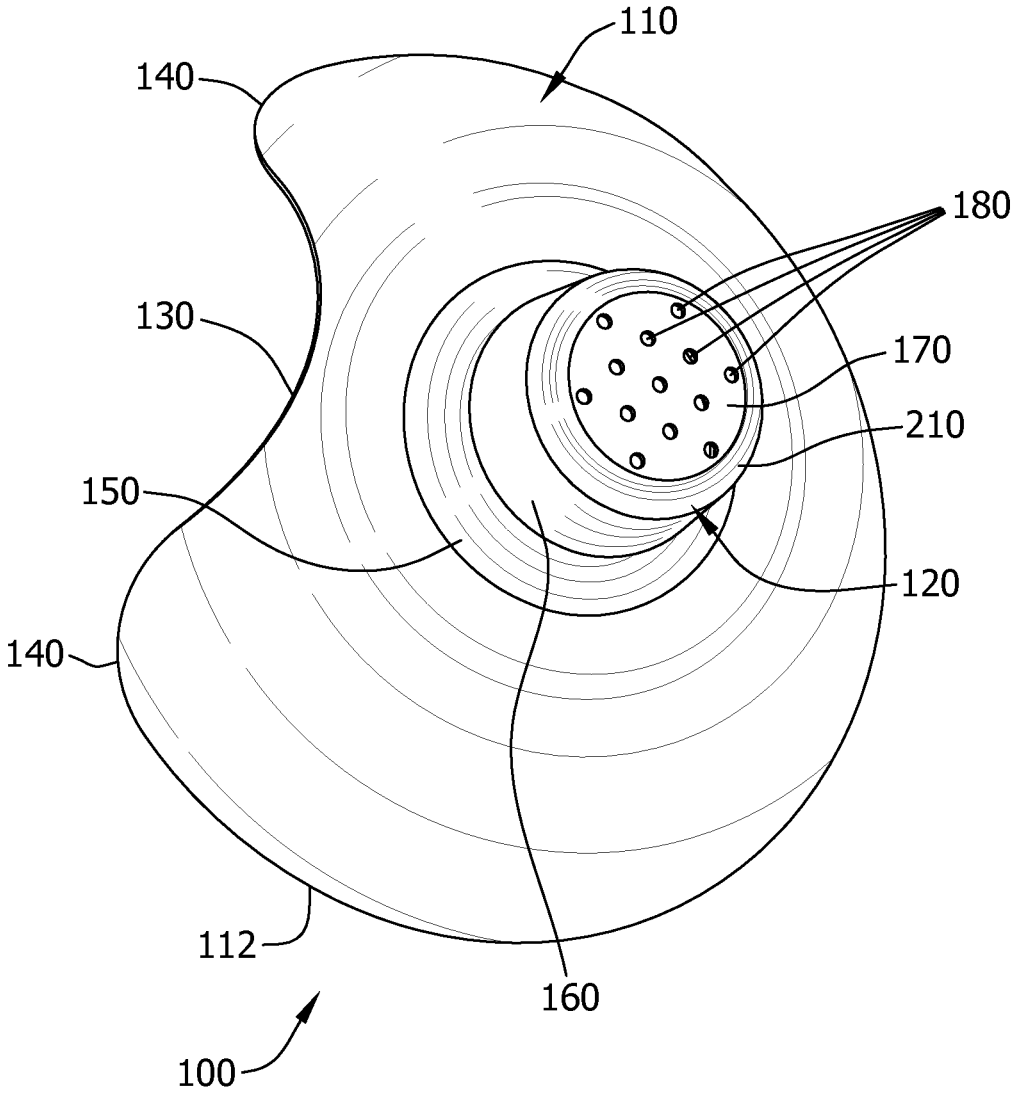
FIG. 1 is a perspective view of one suitable embodiment of a nipple shield.

The nipple portion 120 extends outward from the crest of the dome shaped base and defines a chamber 122 (FIG. 3) configured to receive the mother's nipple therein. As seen in FIG. 4, the nipple portion 120 and the base portion 110 are suitably concentric about the longitudinal axis LA of the nipple shield 100. More particularly, in the illustrated embodiment, the nipple portion 120 includes a first transition portion 150 for transitioning the base portion 110 into the nipple portion, a tubular sidewall 160 extending outward from the first transition portion, and a generally flat end wall 170 having a plurality of openings 180 therein (FIGS. 1-3). The openings 180 in the end wall 170 allow milk expressed by the nursing mother to pass from her nipple through the end wall to the baby's mouth. The illustrated end wall 170 has thirteen generally circular openings 180 but it is understood that more or fewer openings can be provided in the end wall 170 and that the openings can have one or more different shapes (e.g., square, triangle, oval, slits) without departing from the scope of this invention.

The sidewall 160 of the nipple portion 120 is tubular and tapers slightly inward as it extends from the base portion 110 to the end wall 170. As a result, a first diameter D1 of the sidewall, which is proximate to the base portion 110, is greater than a second diameter D2, which is proximate to the end wall 170. In the illustrated embodiment, the first diameter D1 is about 18 mm and the second diameter D2 is about 16 mm. Suitably, the ratio between the first diameter and second diameter (i.e., a first diameter-to-second diameter ratio) is between about 1.05 and about 1.2. Thus, it is understood that the first and second diameters of the tubular sidewall can be different than 18 mm and 16 mm, respectively.

Additionally, the nipple portion 120 has a height H such that a diameter-to-height ratio of the nipple portion is between about 1.15 and about 1.4. In the illustrated embodiment, for example, the height is about 13 mm. The nipple shield 100 illustrated in FIGS. 1-8 is considered herein to be of a "medium" size, which is intended to fit a majority of women. For example, the illustrated nipple shield 100 is sized and shaped to fit approximately 80% of women. It is contemplated, however, that the nipple portion 120 or, more specifically, the sidewall 160 can have any suitable diameter and height without departing from the scope of this invention.

The nipple portion 120 includes a second transition portion 210 transiting the tapered sidewall 160 to the generally flat end wall 170. The end wall 170, which is slightly convex, has a radius (not shown) of about 50 mm. It is contemplated that the end wall 170 can be flat or have any suitable radius without departing from the scope of this invention.

In the illustrated embodiment, the nipple portion 120 includes thirteen openings 180. As seen in FIG. 1, one of the openings 180 is positioned generally at the center thereof (i.e., aligned with the longitudinal axis LA of the nipple shield 100). Six additional openings (broadly, a first set of openings) are located proximate to an outer edge of the end wall 170 and are evenly spaced apart. As a result, these six openings define an outer, first hexagonal pattern about the center. Six more openings 180 (broadly, a second set of openings) are positioned about halfway between the center and the outer edge of the end wall. These six openings 180 are arranged in a second hexagonal pattern that is smaller than the first hexagonal pattern about the center of the end wall 170. The openings 180 defining the two hexagonal patterns are positioned at the vertices of a regular hexagram. It is contemplated, however, that there may be any suitable number of openings 180 in any suitable pattern without departing from the scope of this invention.

During use and as illustrated in FIG. 8, the nipple shield 100 can be placed on the breast of the nursing mother to shield the nipple and a portion of the breast that surrounds the nipple while breastfeeding a baby. More specifically, the nipple shield 100 is placed directly on the breast such that base portion 110 cups a portion of the breast surrounding the nipple, and the nipple portion 120 receives the nipple within its chamber 122. During use, the nipple shield 100 is oriented by the mother to enable the baby to fit her nose against the mother's breast at the cutout 130 during feeding. The orientation of the nipple shield 100 can be manually manipulated by the mother to properly align the cutout 130 with the baby's nose and thereby allow the baby to latch onto the breast in any suitable orientation.

With the nipple shield 100 properly placed on the mother's breast, the baby is able to nurse in a conventional manner. To feed (i.e., express milk from the mother's breast), the baby closes her mouth on the nipple shield 100 about the nipple portion 120 such that the baby is able to compress milk sinuses in the breast through the nipple shield 100. As the baby sucks on the nipple shield 100, the mother's nipple is drawn up into the chamber 122 of the nipple portion 120. The nipple shield 100, as a result of the material from which it is fabricated from and its thickness (e.g., 0.4 mm), does not significantly effect the baby's ability to stimulate the mother's breast and/or nipple.

The openings 180 in the end wall 170 of the nipple portion 120 allow milk to flow from the mother's nipple to the baby's mouth during feeding with little or no pooling within the chamber 122 in the nipple portion. The chamber 122 of the nipple portion 120 is suitably sized to reduce any area therein where milk can pool.

As mentioned above, the nipple shield 100 illustrated in FIGS. 1-8 is suitably sized to fit a majority of women. It is contemplated, however, that the nipple shield can be sized other than illustrated in FIGS. 1-8 to fit a different range of women. For example, FIG. 9 illustrates a nipple shield 300 being sized smaller than the nipple shield 100 illustrated in FIGS. 1-8 and FIG. 10 illustrates a nipple shield 500 having a larger size.

Figure 9:
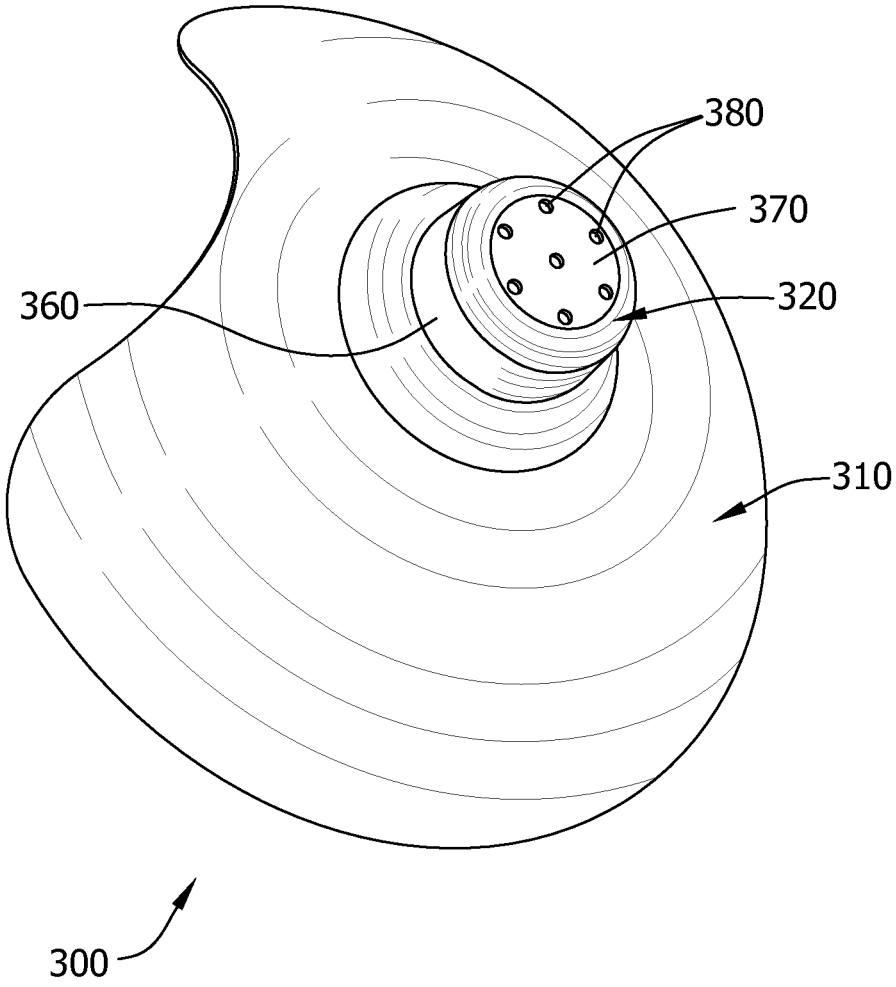
FIG. 9 is a perspective view of another suitable embodiment of a nipple shield.

As seen in FIG. 9, the small nipple shield 300 includes a base portion, indicated generally at 310, and a nipple portion, indicated generally at 320, extending outward from the base portion 310. The nipple portion 320 of the small nipple shield 300 includes an end wall 370 and a plurality of openings 380 therein. In the illustrated embodiment, the nipple portion 320 includes seven openings 380. One of the openings 380 is positioned at the center of the end wall 370 and six additional openings 380 are positioned in a hexagonal pattern about the center. In the illustrated embodiment, the openings 380 of the hexagonal pattern are positioned about 4 mm from the center at the outer edge of the end wall 370.

Figure 10:
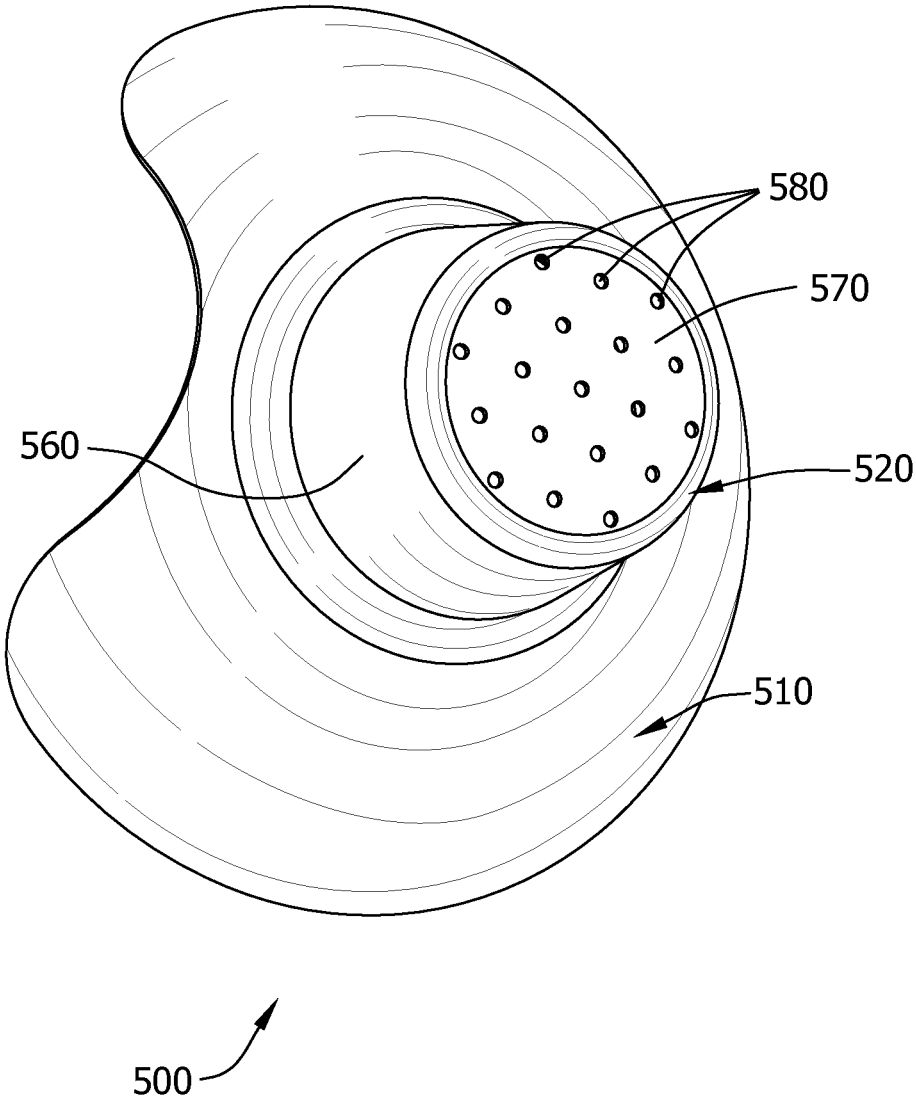
FIG. 10 is a perspective view of yet another suitable embodiment of a nipple shield.

The large nipple shield 500 includes a base portion 510 and a nipple portion 520 extending outward from the base portion (FIG. 10). The nipple portion 520 of the large nipple shield 500 includes one opening 580 positioned at the center, six additional openings positioned in a first hexagonal pattern about the center, six more openings positioned in a second hexagonal pattern that is larger than the first hexagonal pattern, and six openings positioned in a third hexagonal patter that is larger than both the first and second hexagonal patterns.

Figure 11:
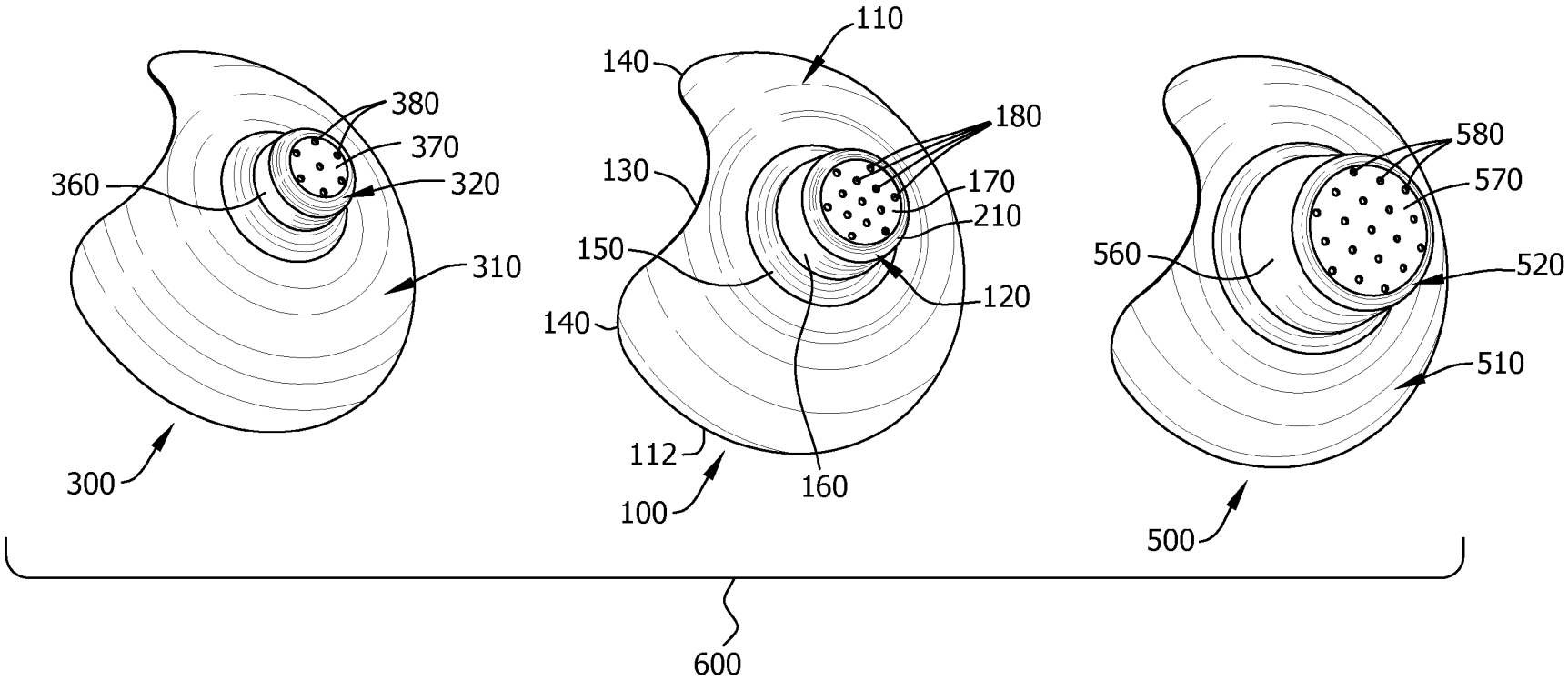
FIG. 11 is a drawing of a product line of nipple shields which includes the three embodiments of the nipple shields illustrated in FIGS. 1, 9, and 10.

FIG. 11 illustrates a product line 600 of nipple shields including a small nipple shield (corresponding to the nipple shield 300 illustrated in FIG. 9), a medium nipple shield (corresponding to the nipple shield 100 illustrated in FIGS. 1-8), and a large nipple shield (corresponding to the nipple shield 500 illustrated in FIG. 10). It is contemplated that nipple shields can be made available in any suitable size or any suitable number of sizes without departing from the scope of this invention.

The nipple portion 320 of the small nipple shield 300 is sized to fit a small nipple, the medium nipple portion 120 of the medium nipple shield 100 is sized to fit a medium nipple, and the nipple portion 520 of the larger nipple shield 500 is sized to fit a large nipple. Each nipple portion 320, 120, and 520 has a first diameter proximate to the base, a second diameter proximate to the end wall, and a height. In the exemplary embodiment, the nipple portion 320 of the small nipple shield 300 includes a sidewall 360 having a first diameter of about 14 mm and a second diameter of about 13 mm. As described above, the sidewall 160 of the medium nipple shield 100 has a first diameter of about 18 mm and a second diameter of about 16 mm. In the exemplary embodiment, the nipple portion 520 of the large nipple shield 500 includes a large sidewall 560 having a first diameter of about 26 mm and a second diameter of about 22 mm.

As such, the sidewalls 360, 160, and 560 have a substantially similar first diameter-to-second diameter ratio. In the illustrated embodiment, the first diameter-to-second diameter ratios of the small, medium, and large nipple portions 320, 120, and 520 are between about 1.05 and 1.2. Additionally, the small, medium, and large nipple portions 320, 120, and 520 have a substantially similar diameter-to-height ratio. In the illustrated embodiment, for example, the diameter-to-height ratio is between about 1.15 and about 1.4.

The base portions 310, 510 of the small and large nipple shields 300, 500 are substantially the same size as the base portion 110 of the medium nipple shield 100. The base portion 110 of the medium nipple shield 100 is described above.

When introducing elements of the present invention or the preferred embodiment(s) thereof, the articles "a", "an", "the", and "said" are intended to mean that there are one or more of the elements. The terms "comprising," "including", and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A nipple shield for shielding a nipple and a portion of a breast that surrounds the nipple of a nursing mother while breastfeeding a baby, said nipple shield comprising:

a base portion having a first radius, and a concave cutout for allowing a nose of the baby to contact the mother's breast during breastfeeding, the concave cutout having second radius smaller than the first radius; and a nipple portion that extends outward from the base portion, the nipple portion comprising a sidewall and a generally flat end wall that has a plurality of openings therein, the nipple portion being configured for receiving the nipple therein and to be placed in the baby's mouth during breastfeeding.

2. The nipple shield of claim 1 wherein the nipple shield is fabricated from a thin, pliant material.

3. The nipple shield of claim 1 wherein the base portion has a generally dome shape.

4. The nipple shield of claim 1 wherein the nipple portion comprises a first transition portion for transitioning the base portion into the nipple portion.

5. The nipple shield of claim 1 wherein the nipple portion has a diameter, a height, and a diameter-to-height ratio that is between about 1.15 and about 1.4.

6. The nipple shield of claim 1 wherein the sidewall of the nipple portion tapers as it extends from the base portion towards the end wall.

7. The nipple shield of claim 1 wherein at least some of the openings in the end wall are arranged in a pattern that is radially symmetrical about a center of the end wall.

8. A nipple shield for shielding a nipple and a portion of a breast that surrounds the nipple of a nursing mother while breastfeeding a baby, said nipple shield comprising:

a base portion having a generally dome shape for cupping the portion of the breast that surrounds the nipple; and a nipple portion extending outward from the base portion and defining a chamber configured to receive the nipple, the nipple portion including a sidewall and a generally flat end wall having a plurality of openings therein, the nipple portion having a diameter, a height, and a diameter-to-height ratio that is between about 1.15 and about 1.4.

9. The nipple shield of claim 8 wherein at least some of the openings are arranged in a hexagonal pattern.

10. The nipple shield of claim 9 wherein the plurality of openings includes a first set of openings arranged in a first hexagonal pattern, and a second set of openings arranged in a second hexagonal pattern.

11. The nipple shield of claim 10 wherein the plurality of openings further includes a third set of openings arranged in a third hexagonal pattern.

12. The nipple shield of claim 9 wherein each of the openings is generally circular.

13. The nipple shield of claim 8 wherein the plurality of openings comprises seven openings.

14. The nipple shield of claim 13 wherein one of the openings is disposed generally in a center of end wall and the other six openings being disposed radially symmetrical about the center of the end wall.

15. The nipple shield of claim 8 wherein the openings are in a pattern that is radially symmetrical about a center of the end wall.

16. A nipple shield product line comprising:

a small nipple shield that comprises a small base portion and a small nipple portion extending outward from the small base portion, the small nipple portion having a first diameter proximate to the small base portion;

a medium nipple shield that comprises a medium base portion and a medium nipple portion extending outward from the medium base portion, the medium nipple portion having a first diameter proximate to the medium base portion; and a large nipple shield that comprises a large base portion and a large nipple portion extending outward from the large base portion, the large nipple portion having a first diameter proximate to the large base portion, wherein each of the small, medium, and large nipple portions have a diameter, a height, and thereby a diameter-to-height ratio, the diameter-to-height ratios of each of the small, medium, and large nipple portions being between about 1.15 and about 1.4, and wherein the medium nipple first diameter-to-small nipple first diameter ratio, and the large nipple first diameter-to-medium nipple first diameter ratio is between about 1.25 and 1.5.

17. The product line of claim 16 wherein each of the nipple portions has an end wall and a plurality of openings therein, wherein at least some of the openings are positioned in a pattern that is radially symmetrical about a center of the respective end wall.

18. The product line of claim 17 wherein the small nipple portion has seven openings, the medium nipple portion has thirteen openings, and the large nipple portion has nineteen openings.

19. The product line of claim 16 wherein each of the nipple portions has a second diameter proximate to an end wall of the nipple portion, and a first diameter-to-second diameter ratio, the first diameter-to-second diameter ratios of the small, medium, and large nipple portions being substantial similar.

20. The product line of claim 19 wherein the first diameter-to-second diameter ratio is between about 1.05 and 1.2.

21. The product line of claim 16 wherein each of the small, medium, and large base portions have generally the same size and shape.

* * * * *